United States Patent [19]

Wright

[11] Patent Number: 4,969,601

[45] Date of Patent: Nov. 13, 1990

[54] DIRECTLY THERMALLY COUPLED ADHESIVE DISPENSER

[75] Inventor: Michael W. Wright, Monterey, Calif.

[73] Assignee: Slautterback Corporation, Monterey, Calif.

[21] Appl. No.: 346,148

[22] Filed: May 1, 1989

[51] Int. Cl.[5] ..... B05B 1/24; B05B 1/20

[52] U.S. Cl. ..... 239/135; 239/566; 239/569; 239/600; 285/332.3

[58] Field of Search ..... 285/918, 332, 332.2, 285/332.3; 118/DIG. 3; 277/168; 239/135, 569, 566, 600; 222/146.2, 146.5

[56] References Cited

U.S. PATENT DOCUMENTS

| | | | |
|---|---|---|---|
| 1,217,859 | 2/1917 | Drader | 285/332.3 |
| 1,810,091 | 6/1931 | Siegle | 285/332 X |
| 2,174,218 | 9/1939 | Greene | 285/332.3 X |
| 2,417,494 | 3/1947 | Hoof | 285/332.2 X |
| 3,395,925 | 8/1968 | Dreiding | 277/168 |
| 4,566,722 | 1/1986 | Huber et al. | 285/332 |
| 4,659,016 | 4/1987 | Faulkner | 239/135 |
| 4,721,252 | 1/1988 | Colton | 239/424.5 |
| 4,735,169 | 4/1988 | Cawston et al. | 118/411 |
| 4,768,718 | 9/1988 | Faulkner | 239/410 |
| 4,774,109 | 9/1988 | Hadzimihalis et al. | 427/286 |
| 4,796,813 | 1/1989 | Marshall | 239/425 |

*Primary Examiner*—Andres Kashnikow
*Assistant Examiner*—Kevin P. Weldon
*Attorney, Agent, or Firm*—Thomas Schneck

[57] ABSTRACT

A hot-melt adhesive dispenser having a multi-orifice nozzle manifold in surface-to-surface heat transfer engagement with a heated member. A first sealing element cooperates with a second sealing element to provide a heated member-to-nozzle manifold engagement which is sufficiently inelastic to inhibit adhesive drool between applications, is leak-resistant, and is unlikely to produce air pockets. The first sealing element is a hollow tapered stem having a base which receives adhesive going from within said heated member. The dimensionally reduced tip of the tapered stem is press fit into an inlet bore of the nozzle manifold for fluid communication with a plurality of nozzles. The second sealing element is a high temperature O-ring seated on that portion of the tapered stem not received within the inlet bore. The tapered stem forms a relatively inelastic fit, while the O-ring provides a relatively elastic fit.

19 Claims, 3 Drawing Sheets

52
50
124
122
102
82
100
88
124
122
58
120
60
122

104
FREE FLOW
106
108
66
48
72
74
68
70
54
76
78
52
50
100
82
88
92
96
96
112
114
62
118
56
116
64

DIRECTLY THERMALLY COUPLED ADHESIVE DISPENSER

TECHNICAL FIELD

The present invention relates to a nozzle assembly for a hot-melt adhesive dispenser and more particularly to an adhesive nozzle assembly having a plurality of outlets for the extrusion of hot-melt adhesive.

BACKGROUND ART

Hot-melt adhesives are used extensively for case and carton sealing on automated packaging machinery, as well as other assembly line applications. For example, FIGS. 1 and 2 illustrate hot-melt adhesive dispensers 10 and 12 in use in an automatic packaging assembly line. The dispensers 10 and 12 are described in detail in U.S. Pat. No. 4,659,016 to Faulkner, III, assigned to the assignee of the present application. As a carton 14 moves along rollers, not shown, hot-melt adhesive is dispensed from nozzles 16 to the outside surfaces of top minor flaps 18 of the carton and to inside surfaces of the bottom major flaps 20. The top-apply dispenser 10 has an inverted T-shaped configuration with the nozzles 16 placed on the front side of a multi-orifice nozzle manifold 22. The bottom-apply dispenser 12 has a Y-shaped configuration with the nozzles 16 supported on a split multi-orifice nozzle manifold 24. Melted adhesive from pressurizing tanks, not shown, is channeled to solenoid valves 26 via hoses 28. Fastening hardware 30 secures a hose 28 to the associated solenoid valve 26. Actuation of the solenoid valve 26 regulates fluid communication between the hose 28 and a plurality of nozzles 16 of the associated nozzle manifold 22 and 24. Thus, the adhesive dispensers 10 and 12 are single-valve dispensers.

Adhesive flow from the solenoid valve 26 is through a heater block 32 having thermal units to maintain the adhesive in a melted state. Brackets 34 are mounted to the heater blocks 32 by bolts 36, fixing the dispensers 10 and 12 in position.

The nozzle manifold 22 is comprised of a center inlet portion 38 and a pair of longitudinal dispenser bars 40, only one of which can be seen in FIGS. 1 and 2. After progressing through the solenoid valve 26 and the heater block 32, adhesive enters a coupling assembly having a pair of swivel nuts 42 and 44 for passage to the inlet portion 38 of the nozzle manifold 22. The coupling assembly places the nozzle manifold in a direct hot-melt material dispensing line with the heater block. As will be explained more fully below, the coupling of the heater block to the nozzle manifold is an important feature of a dispenser 10 and 12. Briefly, this importance lies in the coupling's effect on nozzle drool between separate adhesive applications and in the ability to compensate for dimensional differences where less than exact manufacturing tolerances are dictated. The coupling assembly which includes swivel nuts 42 and 44 provides an inelastic coupling, and the swivel nuts allow for dimensional tolerances of the interconnected heater block 32 and nozzle manifold 22.

An advantage of the above-described dispensers 10 and 12 is that a single solenoid valve 26 controls adhesive flow to all of the nozzles 16 of a nozzle manifold 22 and 24. Dispensers having a separate valve for each separate nozzle tend to have varying flow rates across the different nozzles. Another advantage is a result of the relationship of the solenoid valve 26, the heater block 32 and the nozzle manifold 22. Where a heater is downstream of a valving point, nozzle drool is a concern. Adhesive which is locked within a heating area may experience a rise in temperature. The coefficient of thermal expansion of the adhesive determines how much drooling will occur if heating of a nozzle manifold causes expansion of adhesive within the manifold. Such expansion forces adhesive from nozzles.

A characteristic of dispensers 10 and 12, however, involves the necessity of the coupling assembly that includes swivel nuts 42 and 44. While thermal expansion in the nozzle manifold is undesirable because nozzle drool will result, it is desirable to minimize any cooling during the passage of hot-melt adhesive through the nozzle manifold, especially during periods between applications when the adhesive is held in the manifold for an extended time. The dispensers 10 and 12 include heat transfer blocks 46 which provide a heat flow path that is separate from the adhesive flow path from the heater block 32 to the associated nozzle manifold 22 and 24. The heat transfer block accomplishes its intended purpose, but is less thermally efficient than would be a direct coupling of the heater block 32 to the nozzle manifold. Such direct coupling is difficult, however, without increasing the tendency of the nozzles 16 to drool between applications. Characteristics of a drool-retardant coupling must include a leak-resistant seal, an inelastic fitting, and an absence of air pockets. Inelasticity inhibits drool-causing expansion and contraction of the coupling as the solenoid valve 26 is activated and deactivated. Air is an expandable gas and air pockets result in a push of the glue at the end of each adhesive application. The coupling assembly of FIGS. 1 and 2 possesses the desired characteristics but at a sacrifice of efficiency of heat transfer to the nozzle manifold.

It is an object of the present invention to provide a hot-melt adhesive dispenser in which a nozzle manifold is downstream of a heating member, with a coupling that enhances thermal efficiency while maintaining the desired characteristics of inelasticity, leak-resistivity, and an absence of air pockets.

DISCLOSURE OF THE INVENTION

The above object has been met with a hot-melt adhesive dispenser having cooperative first and second sealing elements in which the first sealing element provides a rigid yet mechanically forgiving fit because of a self-seating characteristic, while the second sealing element has an elastic quality which provides a tight seal but is less drool retardant.

The first sealing means is a hollow tapered stem having a diametrically reduced end which is press fit into an inlet bore of a nozzle manifold having a plurality of nozzles. The inlet bore of the nozzle manifold is in fluid communication with each of the nozzles. The tapered stem, and therefore the nozzle manifold as well, are downstream from a heating member for maintaining adhesive in a molten state. The nozzle manifold is in surface-to-surface heat transfer engagement with the heating member, thereby promoting thermal conductivity. The base of the tapered stem receives adhesive which has progressed through the heating member. Preferably, the tapered stem is at the end of a pipe. The press fit of the tapered stem into the inlet bore of the nozzle manifold is a relatively inelastic fit, but because the stem has a frustroconical shape it is possible to compensate for dimensional variances resulting from manufacturing tolerances.

The second sealing element is an elastomeric member, preferably an O-ring, which fits about a portion of the tapered stem not received within the inlet bore of the nozzle manifold. The O-ring is made of a heat resistant material and is pressed in place against the nozzle manifold at the area about the inlet bore. Like the tapered stem, the O-ring allows for tolerances in dimensions of the coupled components.

An advantage of the present invention is that a heater is upstream of the nozzle manifold so that thermal expansion does not take place within the manifold and, moreover, valving takes place upstream of the heating member so that one valve controls all of the nozzles on the nozzle manifold. Another advantage is that in coupling the heating member to the nozzle manifold, the direct coupling promotes efficiency of heat transfer while the O-ring provides sufficient assurance against leakage. A further advantage is that the coupling of the heating member in the nozzle manifold does not require exacting tolerances, so that a high cost of manufacture need not be passed on to an end user.

BRIEF DESCRIPTION OF THE DRAWINGS

FIG. 5 is a partial exploded view of the dispenser of FIG. 4.

BEST MODE FOR CARRYING OUT THE INVENTION

Figure 3:
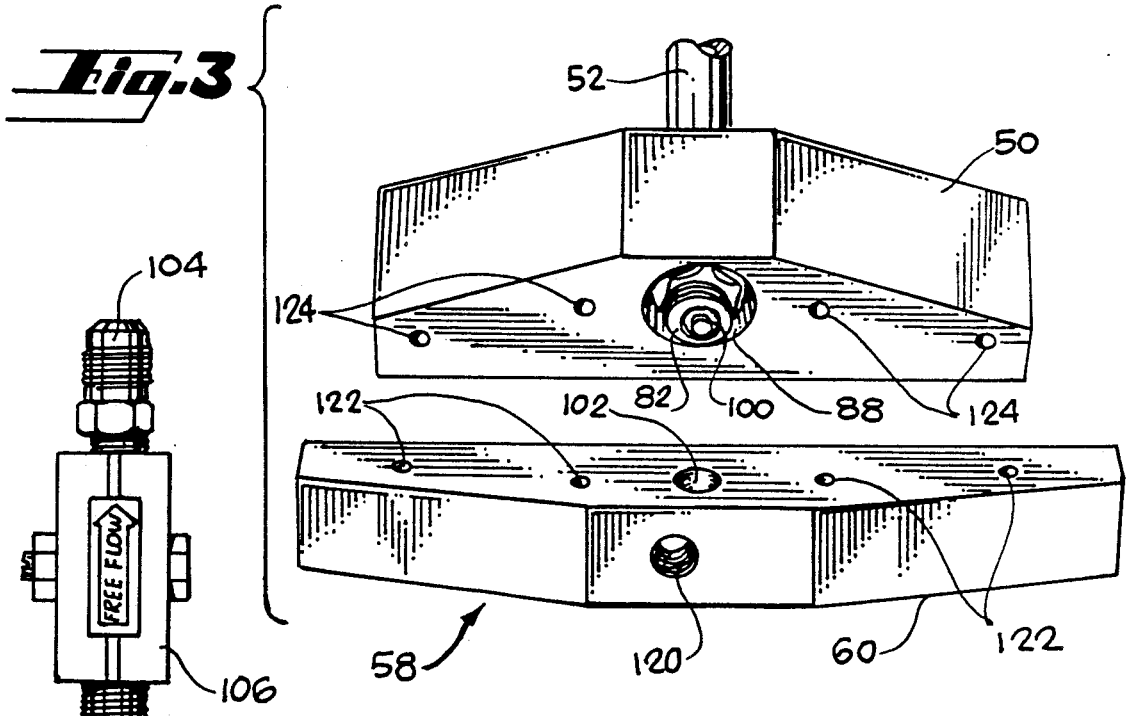
FIG. 3 is a side view of a heating member and nozzle manifold in accord with the present invention.
Figure 4:
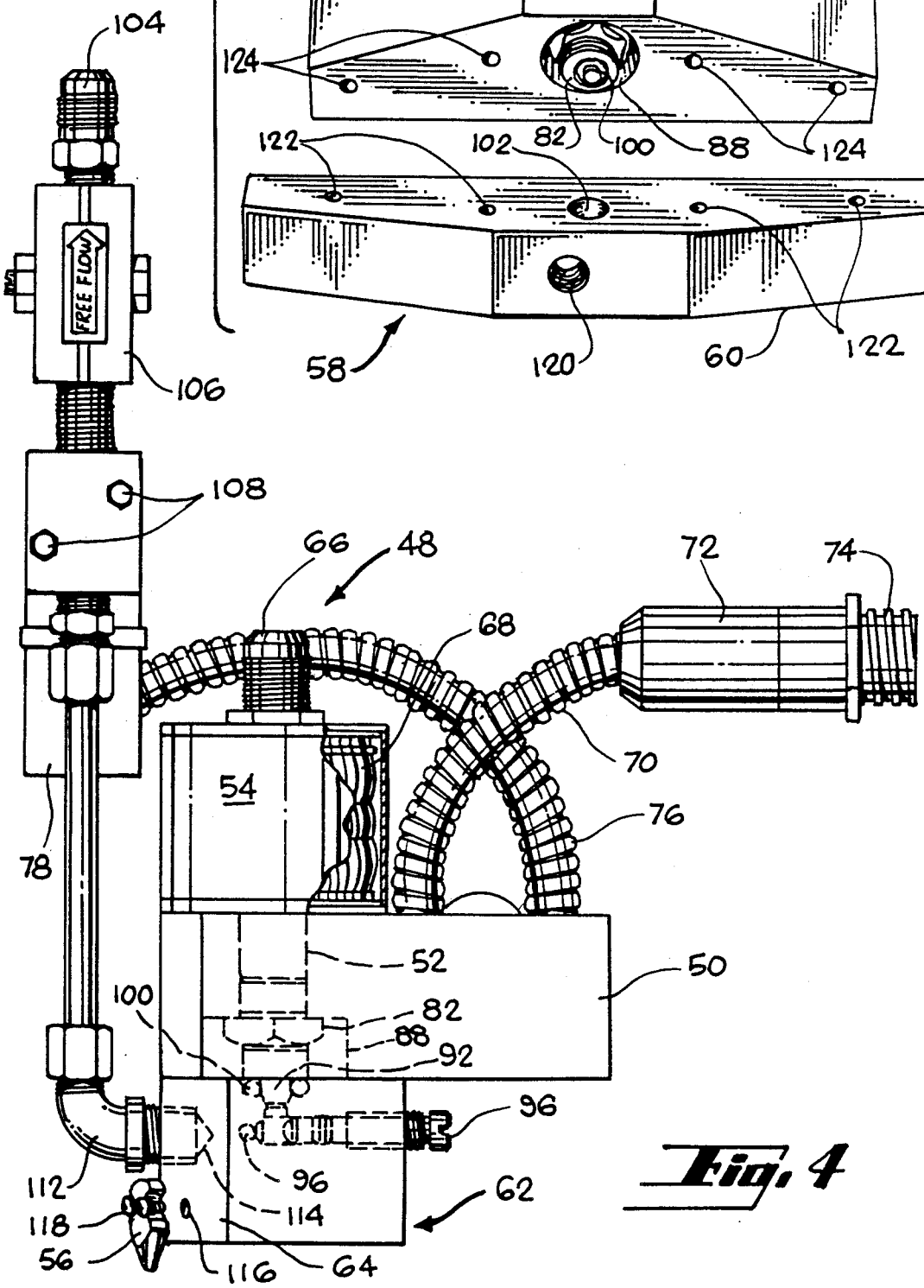
FIG. 4 is a side view of a hot-melt adhesive dispenser which includes a second embodiment of a heating member and nozzle manifold.

With reference to FIGS. 3 and 4, a hot-melt adhesive dispenser 48 includes a heating member 50, an adhesive pipe 52 which passes through the heating member, and a solenoid valve 54. The dispenser 48 also includes a nozzle manifold having a plurality of nozzles 56. The nozzle manifold 58 of FIG. 3 includes nozzles, not shown, on a lowermost surface 60, whereas the nozzles 56 of the manifold 62 shown in FIG. 4 are attached to a side surface 64 of a manifold. Other than the placement of the nozzles, however, the nozzle manifolds 58 and 62 are substantially identical and description of one applies equally well to the other.

Hot-melt adhesive enters the dispenser 48 through an axial bore in an externally-threaded shaft 66 of the solenoid valve 54. Typically, the adhesive is applied from a melting tank, not shown, through hoses coupled to the threads of the shaft 66. Current through the windings 68 of the solenoid valve is controlled through power lines in a flexible conduit 70 to selectively permit passage of adhesive through the heating member 50. Passage of adhesive through the heating member is via the pipe 52 which is in heat transfer relation with the heating member. Alternatively, a bore through the heating member may act as the piping to the nozzle manifolds 58 and 62. That is, the adhesive pipe 52 is not itself a critical element of the present invention.

The heating member 50 includes a pair of 500 watt heaters, not shown, which maintain hot-melt adhesive in a molten condition during passage to the nozzle manifolds 58 and 62. Power lines in the flexible conduit 70 provide power to the heaters. A plug 72 having a threaded end 74 is selectively coupled to an attachment, not shown, for applying power to the dispenser 48. A total of six power lines are housed within the conduit 70, with two lines dedicated to the solenoid valve 54, two lines dedicated to the heaters, and the remaining lines passing through a second flexible conduit 76 for activation of an air solenoid 78 to be explained more fully below.

Referring now to FIGS. 3–5, but particularly to FIG. 5, the adhesive pipe 52 is an internally-threaded pipe which is fastened to a first end 80 of a fitting 82. The adhesive pipe has an outside diameter slightly smaller than a bore 84 through the heating member 50. The fitting 82 is a unitary member, typically made of brass, and has a hexagonally shaped midportion 86 which prevents passage of the fitting 82 through the bore 84. Instead, the hexagonally shaped midportion abuts the inner extremity of a recess 88 dimensioned to receive the fitting. Abutment of the hexagonally shaped mid portion 86 against the heating member 50 enhances heat transfer from the heating member to the flow of adhesive.

Like the first end 80 of the fitting 82, a second end 90 is externally threaded. Preferably, these threads are not used, but the function of the threads will be explained below with reference to FIG. 6. Projecting from the second end 90 is a frustroconically shaped stem 92. In a preferred embodiment the stem has a degree of taper of four degrees from the base to the tip. While the four-degree taper is not critical, the taper should remain in the range of one degree to ten degrees. This taper has been exaggerated in the figures for purpose of illustration.

The tip of the tapered stem 92 is received within a cylindrical inlet bore 94 of the nozzle manifold 62. The inlet bore 94 is in fluid communication with a longitudinal adhesive passageway 96 which passes along the length of the nozzle manifold. Each nozzle 56 is linked to the longitudinal adhesive passageway 96 for extrusion of hot-melt adhesive through the nozzle. A regulating material adjustment screw 98 may be rotated to increase or decrease the adhesive extruded from the nozzles 56. Clockwise rotation of the material adjustment screw 98 causes a partial blockage of adhesive from the inlet bore 94 to the adhesive passageway 96. On the other hand, counterclockwise rotation has the capability of increasing adhesive flow from the nozzles. Typically, each of the nozzles 56 includes a separate material adjustment screw so that uniformity of extrusion is assured.

As noted above, the tip of the frustroconically shaped stem 92 is received within the inlet bore 94. The tip is press fit into the inlet bore to provide a relatively inelastic fit for material flow into the nozzle manifold 62. Manufacture of the heating member 50, the nozzle manifold 62, and the fitting 82 includes tolerances which result in dimensional variations among manufacturing lots. By utilizing a press fit engagement of the frustroconically shaped stem 92 into the cylindrical inlet bore 94, the fitting allows for dimensional variations. Such allowance is facilitated by a heat-resistant O-ring 100 which fits about the portion of the tapered stem 92 not received within the inlet bore. The O-ring 100 may be made of fluoroelastomer material resistant to attack by corrosive chemicals up to 400° F., such as the material sold under the trademark Viton. The O-ring 100 and a portion of the second end 90 of the fitting 82 are received within a recess 102 of the nozzle manifold 62. The O-ring 100 is pressed against the inner extremity of the recess 102 by contact with the second end 90.

The tapered stem 92 acts as a primary seal, with a slight press fit into the inlet bore 94 of the nozzle manifold 62. This primary seal is not a guaranteed seal because of the pressures involved with pumping the viscous adhesive. The O-ring 100, on the other hand, is a better seal than the tapered stem in terms of not allowing adhesive to enter into unwanted areas, but the O-ring is less desirable in terms of elasticity and other characteristics which inhibit nozzle drool between adhesive applications. Elasticity is an important characteristic since as adhesive pumping pressure is applied and then released, any elasticity in a coupling is greatly exaggerated. The tensioning and relaxing of pressure experienced during assembly line carton sealing causes an oscillation which results in drool from the nozzles 56 between adhesive applications. The primary seal of the tapered stem cooperates with the O-ring since the press fit of the tapered stem into the nozzle manifold 62 at the very least inhibits the tendency of an O-ring to oscillate as the solenoid valve 54 is circulated on and off.

Moreover, the cooperation of the tapered stem 92 and the O-ring 100 reduces the risk of formation of an air pocket at the coupling assembly. Air pockets, like elasticity, promote adhesive drool from nozzles 56. Air is an expandable gas, so that upon release of pressure for pumping the adhesive the air in any air pockets expands. Such expansion provides a force for undesired extrusion from the nozzles 56.

Referring to FIG. 4, as noted above the hot-melt adhesive dispenser 48 includes an air solenoid 78 which is activated by power lines extending through the second flexible conduit 76. Pressurized gas, preferably air, is received at an externally-threaded fitting 104 from a pressurized gas source, not shown. A regulator 106 may be adjusted to permit a free escape of gas, thereby determining the pressure of gas at the air solenoid 78. Internally threaded holes 108 permit mounting of the air solenoid 78 to a bracket or the like. The air solenoid selectively permits passage of the pressurized gas into an aluminum tubing 110 which is fastened to an elbow fitting 112. From the elbow fitting, pressurized gas is received within a longitudinal bore 114 in the nozzle manifold 62. Each nozzle 56 includes not only an adhesive passageway, but at least one air passageway. The position of the adhesive passageway relative to the flow of air is dependent upon the desired adhesive pattern for sealing of a box or other substrate. Air pressure to a particular nozzle 56 may be adjusted by rotation of a set screw within a threaded hole 116, thereby regulating pinching of an air passageway to the particular nozzle 56. A pair of screws 118 having enlarged heads fix the nozzles in place against the manifold 62.

Referring now to FIG. 3, the elbow fitting 112 of FIG. 4 is fastened within a threaded hole 120 which leads to the longitudinal bore of the nozzle manifold 58. The nozzle manifold 58 is secured to the heating member 50 by screws which pass through the nozzle manifold at holes 122 for receipt within holes 124 of the heating member.

Figure 6:
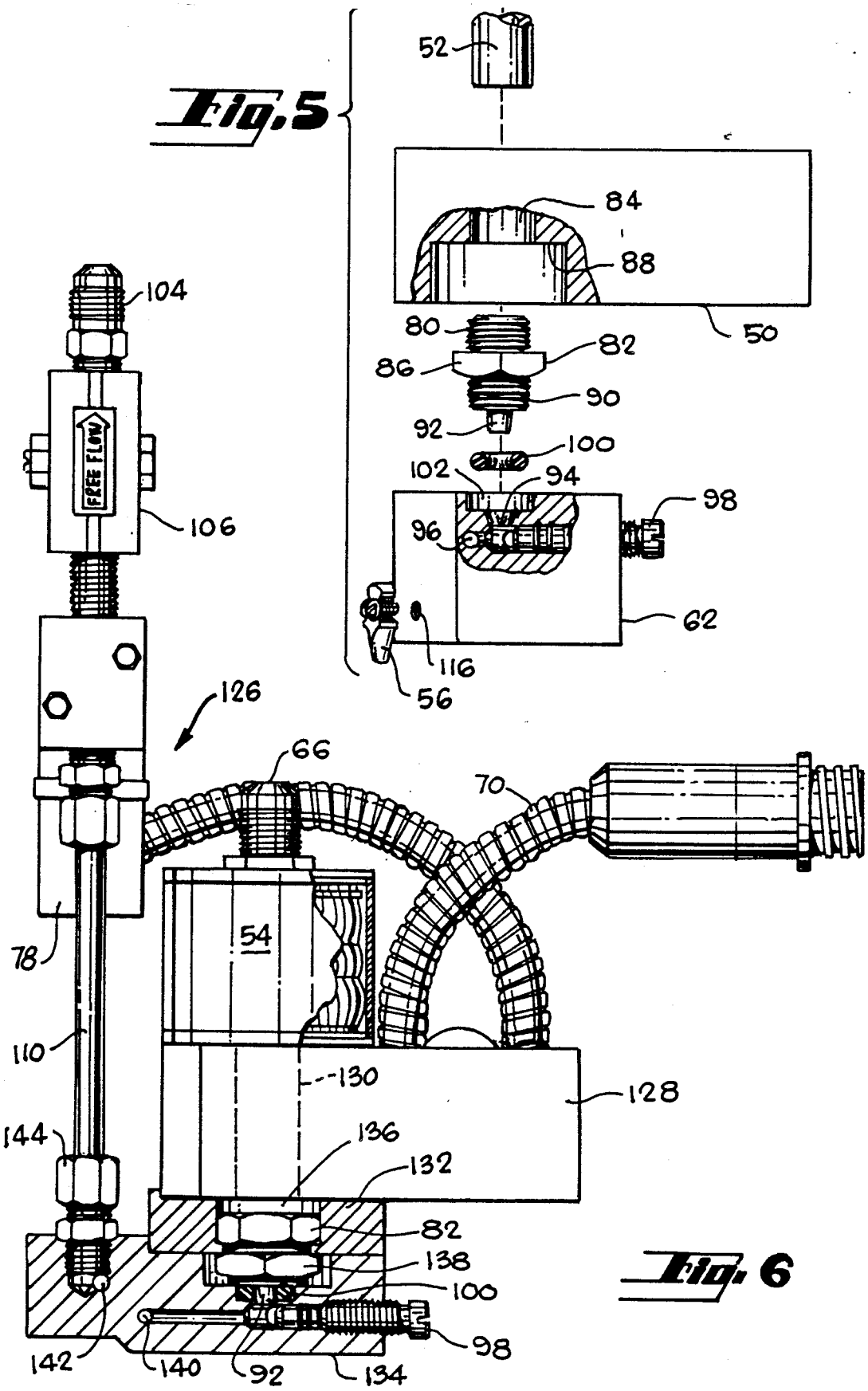
FIG. 6 is a partially sectional side view of a second embodiment of a hot-melt adhesive dispenser.

A second embodiment of the present invention is shown in FIG. 6. Because the second embodiment closely resembles the embodiment of FIG. 4, a detailed description of each part will be omitted and, where beneficial, identical reference numerals will be used. Again, hot-melt adhesive enters an adhesive dispenser 126 from a hose, not shown, connected to an externally threaded shaft 66. The on-off circulation of adhesive application, which is necessary in assembly line sealing, is provided by a solenoid valve 54. Power lines for the solenoid valve, as well as for a heating member 128 and an air solenoid 78, are housed within flexible conduits 70 and 76. The solenoid valve 54 determines flow through a pipe 130 that is in heat transfer engagement with the heating member 128.

Attached to the end of the pipe 130 is a fitting 82 that is identical to the fitting shown in FIG. 5. Unlike the heating member described above, the heating member 128 of FIG. 6 does not include a recess to receive a portion of the fitting 82. Instead, a heated spacer 132 having a central through bore is included. The heated spacer 132 is a longitudinally extending member having a length corresponding to length of a nozzle manifold 134. The heated spacer 132 is captured between the heating member 128 and the nozzle manifold 134 and provides more uniform heat dispersion along the length of the nozzle manifold.

An O-ring 136 is trapped between the fitting 82 and the heating member 128. At the second end 90 of the fitting, illustrated in FIG. 5, is a retainer nut 138 that secures the heated spacer 132. As above, the tapered stem 92 is press fit into an inlet bore of the nozzle manifold 134. The tapered stem provides a primary seal and an inelastic coupling for the flow of adhesive into the nozzle manifold. The inelastic coupling inhibits oscillation of an elastic high temperature O-ring 100 which receives the tapered stem and provides a secondary seal. The secondary seal is more desirable in terms of assurance against leaking, but the elasticity of the O-ring makes the cooperation of the primary seal and a secondary seal desirable for reducing the risk of adhesive drool between applications.

A material adjustment screw 98 may be rotated to partially obstruct fluid communication between the stem 92 and a longitudinal bore 140 through the nozzle manifold 134. Each of a plurality of nozzles, not shown, on the manifold receives adhesive via the longitudinal bore 140. Functionally, pressurized gas may be supplied to the nozzles from a second longitudinal bore 142. The gas enters the hot-melt adhesive dispenser 126 at member 104, and the pressure of the gas may be adjusted by a regulator 106. Power lines from a flexible cable 76 activate an air solenoid 78 to initiate gas flow through an aluminum tubing 110 into an adapter assembly 144 threaded into the nozzle manifold 134.

Figure 1:
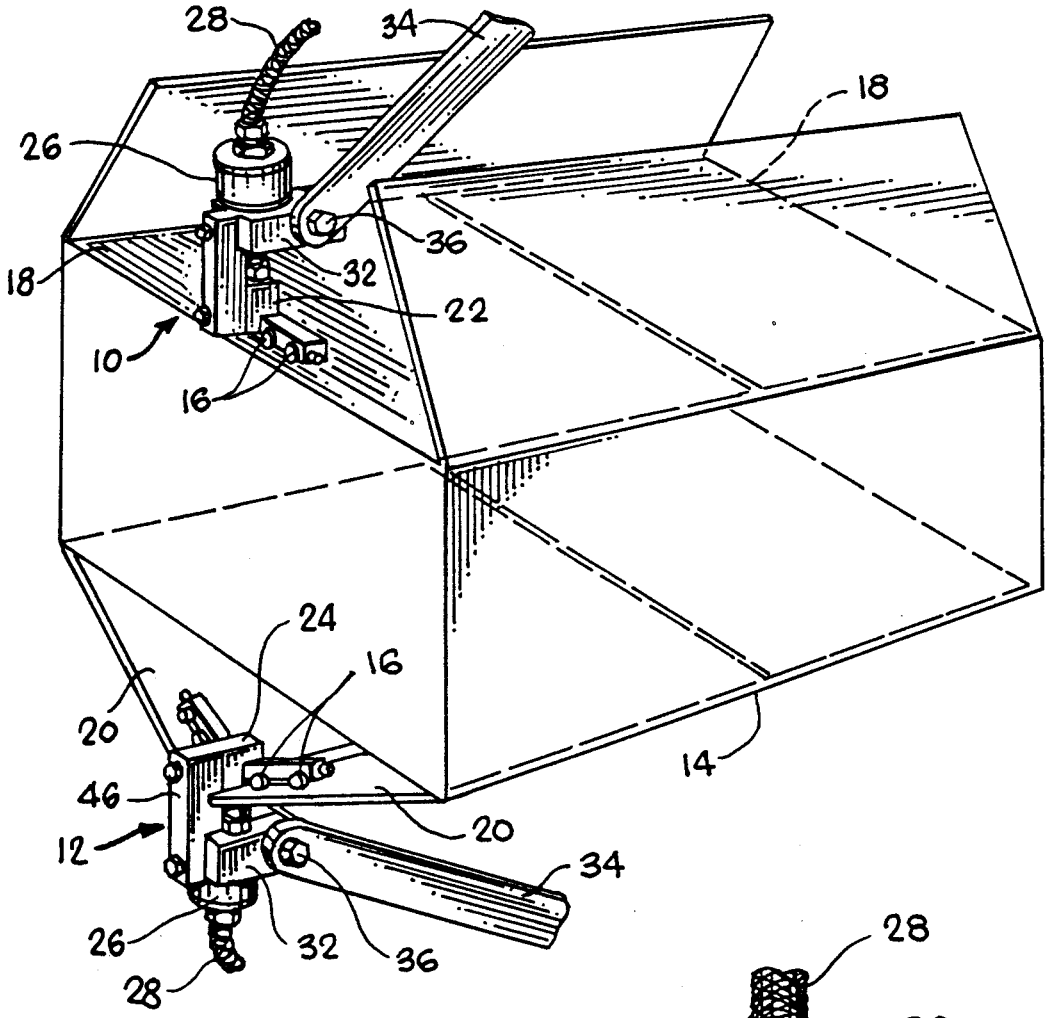
Fig. 1 (PRIOR ART)
FIG. 1 is a perspective view showing a prior art apparatus in a carton sealing configuration for the application of hot-melt adhesive to carton flaps.
Figure 2:
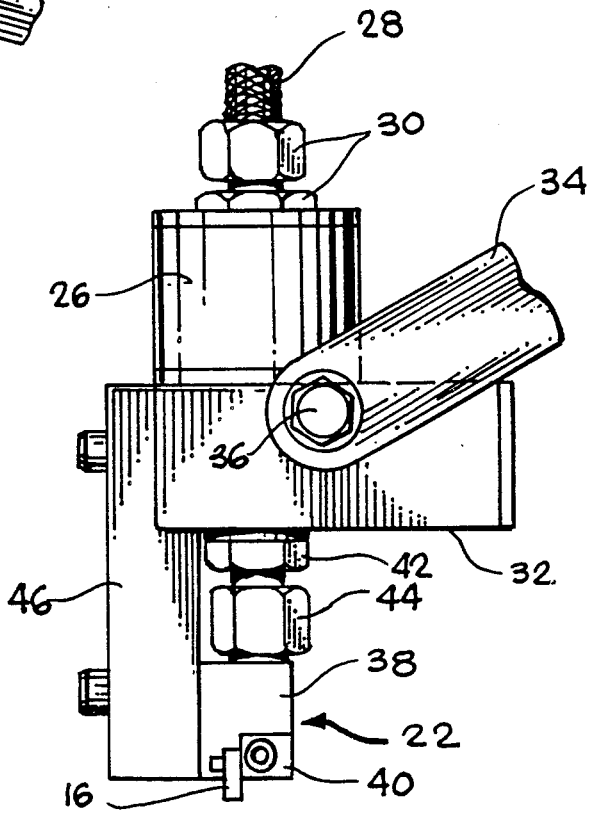
Fig. 2 (PRIOR ART)
FIG. 2 is a side view of the manifold of FIG. 1.

While the adhesive dispenser 126 differs from the dispenser 48 of FIG. 4 by inclusion of a heated spacer 132, the adhesive dispenser 126 is in keeping with the present invention. Both embodiments provide an improvement over the apparatus shown in FIG. 1 by significantly enhancing the efficiency of heat transfer from a heating member to a nozzle manifold. Such enhancement is possible by direct coupling of a heated member to the nozzle manifold, whether the heated member is the metallic spacer 132 or a heated block 128. In both cases, the self-seating press fit coupling of the tapered stem 92 along with the high temperature O-ring 100 provide a fitting which allows for dimensional variances in component manufacture and still retain the necessary characteristics of inelasticity, leak-resistivity and an absence of air pockets.

While the present invention has been described and illustrated as sealing cartons on an assembly line, the hot-melt adhesive dispensers may be used in other applications. Moreover, the orientation of the tapered stem 92 may be reversed so that the tapered stem is fixed to the nozzle manifold, rather than the pipe. That is, the dimensionally reduced tip of the tapered stem may be press fit into an outlet bore in the pipe, with the O-ring 100 still being seated on the stem.

I claim:

1. An apparatus for the dispensing of hot-melt adhesive comprising, a heated member having a bore to receive a flow of hot-melt adhesive therethrough, valving means for regulating flow of adhesive through said heated member, a nozzle manifold in surface-to-surface contact with said heated member, said nozzle manifold having an inlet bore in fluid communication with said valving means to receive said flow of adhesive and further having a plurality of nozzle outlets in fluid communication with said inlet bore, and cooperative first and second sealing means for forming a leak-resistant fit for said receiving of said adhesive flow into said inlet bore, said first sealing means including a hollow stem having a first portion and a second portion, said first portion being frictionally retained within said inlet bore, said second sealing means including an elastomeric member surrounding said second portion of said stem at the exterior of said inlet bore.

2. The apparatus of claim 1 wherein said stem has a frustroconical configuration having a diametrically smaller end press fit into said inlet bore.

3. The apparatus of claim 1 wherein said valving means includes a solenoid and a pipe passing through said heated member, said solenoid selectively permitting flow of adhesive within said pipe, said stem disposed at an end of said pipe distal said solenoid, said stem having a taper from larger to smaller from said pipe to said inlet bore on the nozzle manifold.

4. The apparatus of claim 2 wherein said frustroconical configuration defines a taper in the range of one degree to ten degrees.

5. The apparatus of claim 1 wherein said elastomeric member is an axially compressible O-ring made of a heat-resistant material.

6. The apparatus of claim 5 wherein said O-ring is made of a fluoroelastomer.

7. The apparatus of claim 1 wherein said heated member is a heater block having thermal units therein.

8. An apparatus for application of a flow of hot-melt adhesive comprising, pipe means for channeling said flow of hot-melt adhesive, valve means for selectively supplying adhesive to a first end of said pipe means, a heated member having a cavity to receive said pipe means therein, said heated member being in heat transfer engagement with said pipe means and being downstream of said valve means, a multi-orifice manifold abutted to said heated member and attached to a second end of said pipe means for adhesive flow therefrom, said manifold having a single inlet and having a plurality of outlet nozzles, first means for sealing said attachment of said manifold to said second end of said pipe means, said first sealing means including a tapered stem extending in a diametrically decreasing direction from one of said manifold and said pipe means for press fit engagement with a bore in the other of said manifold and said pipe means, and second means for sealing said attachment of said manifold to said pipe means, said second sealing means functioning cooperatively with said first sealing means and including a heat-resistant O-ring seated about said tapered stem.

9. The apparatus of claim 8 wherein said tapered stem is made of a rigid material and said O-ring is made of a heat-resistant elastic material.

10. The apparatus of claim 8 further comprising a heater block having thermal units therein, said heated member being being a metallic spacer abutting said manifold along a first surface of said spacer and abutting said heater block to a second surface of said spacer opposite to said first surface.

11. The apparatus of claim 8 wherein said heated member includes heating elements and wherein said heated member is fastened to said nozzle manifold by threaded fasteners.

12. The apparatus of claim 8 wherein said tapered stem is fixed at the base of said tapered stem to a pipe shoulder, said O-ring being axially compressible and captured between said pipe shoulder and said manifold.

13. The apparatus of claim 8 wherein said tapered stem extends from said pipe means and wherein said bore is an inlet bore of said manifold.

14. The apparatus of claim 8 wherein said tapered stem has a portion at the exterior of said bore, said O-ring seated about said portion.

15. A hot-melt adhesive dispenser comprising, a source of hot-melt adhesive, means for valving a flow of said adhesive from said source, a heating member downstream of said valving means and in heat transfer engagement with said flow of adhesive, said heating member having a thermal unit operatively associated therewith, a nozzle manifold in surface-to-surface heat transfer engagement with said heating member, said nozzle manifold having an inlet bore in fluid communication with said source of adhesive downstream of said heating member, said nozzle manifold having a plurality of nozzle outlets in fluid communication with said inlet bore, and first and second means for sealing said inlet bore, said sealing means including a rigid tapered stem having a reduced end pressure fit into said inlet bore, said second sealing means including a resilient annular seal surrounding a portion of said tapered stem extending outside of said inlet bore.

16. The dispenser of claim 15 wherein said tapered stem has a frustroconical configuration.

17. The dispenser of claim 15 wherein said heating member has a cavity therethrough, said flow of adhesive passing through said cavity.

18. The dispenser of claim 15 wherein said annular seal is a heat-resistant O-ring.

19. The dispenser of claim 15 wherein said inlet bore of said nozzle manifold is the single inlet for flow of said adhesive into said nozzle manifold.

* * * * *